US005676165A

United States Patent [19]

Bannett

[11] Patent Number: 5,676,165

[45] Date of Patent: Oct. 14, 1997

[54] ARTIFICIAL NAIL TIP

[76] Inventor: Ronald M. Bannett, 12200 NW. 30th St., Sunrise, Fla. 33323

[21] Appl. No.: 640,600

[22] Filed: May 1, 1996

[51] Int. Cl.[6] ..... A45D 31/00

[52] U.S. Cl. ..... 132/73

[58] Field of Search ..... 132/73, 73.5, 285, 132/333

[56] References Cited

U.S. PATENT DOCUMENTS

| | | | |
|---|---|---|---|
| 2,941,535 | 6/1960 | Lappe | 132/73 |
| 4,625,740 | 12/1986 | Roth | 132/73 |
| 4,805,645 | 2/1989 | Schiff et al. | 132/73 |
| 5,070,892 | 12/1991 | Trematerra | 132/73 |
| 5,450,864 | 9/1995 | LaJoie et al. | 132/73 |
| 5,467,787 | 11/1995 | Mast et al. | 132/73 |

*Primary Examiner*—Todd E. Manahan

*Attorney, Agent, or Firm*—Malin, Haley, DiMaggio & Crosby, PA

[57] ABSTRACT

An artificial nail tip having a front portion and a back portion is disclosed. The back portion is relatively thinner as compared to the front portion defining an attachment area where the artificial nail tip is attached to a user's natural nail. A substantially "X" shaped cutout is defined in the back portion to provide strength to the artificial nail as well as reducing the chance of cracking or weakening the artificial nail tip during conforming the nail tip to the wearer's natural nail.

20 Claims, 2 Drawing Sheets

ARTIFICIAL NAIL TIP

BACKGROUND OF THE INVENTION

1. Field of the Invention

The present invention relates generally to artificial nail tips and more particularly to an artificial nail tip which provides for greater strength and reduces cracking and weakening of the nail tip when it is applied.

2. Description of the Prior Art

Artificial nail tips have been used for many years to extend the natural nail, giving the wearer a longer looking fingernail. Normally, an artificial nail tip is made out of a plastic like material in the general shape of a rectangle. The back end, which serves as the attachment end, can vary in shape. However, the back end is usually rounded at the corners for comfort and fit to the natural nail bed. Furthermore, the attachment area of the artificial nail is also normally thinner as compared to the tip area to allow the artificial nail to blend into the natural nail after being glued on. The thinner attachment area also serves as an approximate guide as to where to place the tip on the nail bed. The line of demarcation between the thin area and the thicker area being normally placed approximately at what would be the end of the wearer's natural nail bed.

When the artificial nail tips are applied professionally, they are normally and practically always covered with some sort of conventional coating for strength purposes. The tip alone is normally not strong enough to withstand the stress that it is subject to by being on the end of a finger. As one's hands are constantly in motion or being utilized for some purpose, the artificial nail tips are constantly getting knocked and hit, which can cause them to break. Covering the nails with a coating provides the nails with necessary strength, thus, reducing breakage. When applying an artificial nail tip, the tip is glued on, usually with a cyanoacrylate adhesive (glue), filed to its desired shape and length, and covered with the coating.

Most nail tips currently on the market have a "full back" area at the attachment end. This type of tip has more area for gluing on to the nail bed and less natural nail exposed for the coating that is applied over it. As the natural nail is less exposed, there is less area for the coating to adhere to. Other conventional tips have the entire back cut out. However, this raises concerns on how securely the tip can be glued onto the natural nail.

An artificial nail tip normally comes already formed with a slight curve going from side to side. However, every person's nails are slightly different, meaning not everyone will have a curve in their natural nail that is the same as the curve of the artificial nail tip that is being applied. As such, when a artificial nail tip is initially applied to the natural nail, it is pressed down and held tightly against the natural nail for maximum adhesion and to assure that there is no space between the nail tip and the natural nail. Frequently, during this stage of application, the stress caused by attempting to conform the artificial nail tip to the shape of the natural nail causes the tip to crack or weaken.

Thus, what is needed in the art, is an artificial nail tip which is designed to reduce cracking or weakening of the nail tip when conforming the nail tip to a natural nail. There is also a need to provide an artificial nail tip which provides a sufficient area for gluing the nail tip to a natural nail, while achieving the reduction of cracking or weakening of the artificial nail tip. It is therefore, to the effective resolution of the aforementioned problems and shortcomings that the present invention is directed.

SUMMARY OF THE INVENTION

The present invention relates to an artificial nail tip having a front portion and a back portion. The back portion is relatively thinner as compared to the front portion and defines an attachment area where the artificial nail tip is attached to a wearer's natural nail. A substantially "X" shaped cutout is defined in the back portion to provide strength to the artificial nail as well as reducing the chance of cracking or weakening the artificial nail tip during conforming the nail tip to the wearer's natural nail.

The "X" shaped cutout, preferably, extends across at least a substantial portion of the length of the thinner attachment area, and can extend across the entire length of the attachment area if desired. The "X" shaped cutout also is preferably disposed at the middle of the width of the attachment area.

It is an object of the present invention to provide an artificial nail tip having increased strength characteristics as compared to conventional artificial nail tips.

It is an another object of the present invention to provide an artificial nail tip which blends in easier with the wearer's natural nail as compared to conventional artificial nail tips.

It is yet another object of the present invention to provide an artificial nail tip which conforms easier to the wearer's natural nail as compared to conventional artificial nail tips.

It is still another object of the present invention to provide an artificial nail tip which reduces cracking or weakening of the nail tip, as compared to conventional artificial nail tips, when conforming the artificial nail tip to the wearer's natural nail.

It is even still another object of the present invention to provide an artificial nail tip which exposes more of the wearer's natural nail to provide a larger area for coating to adhere to.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 1A:
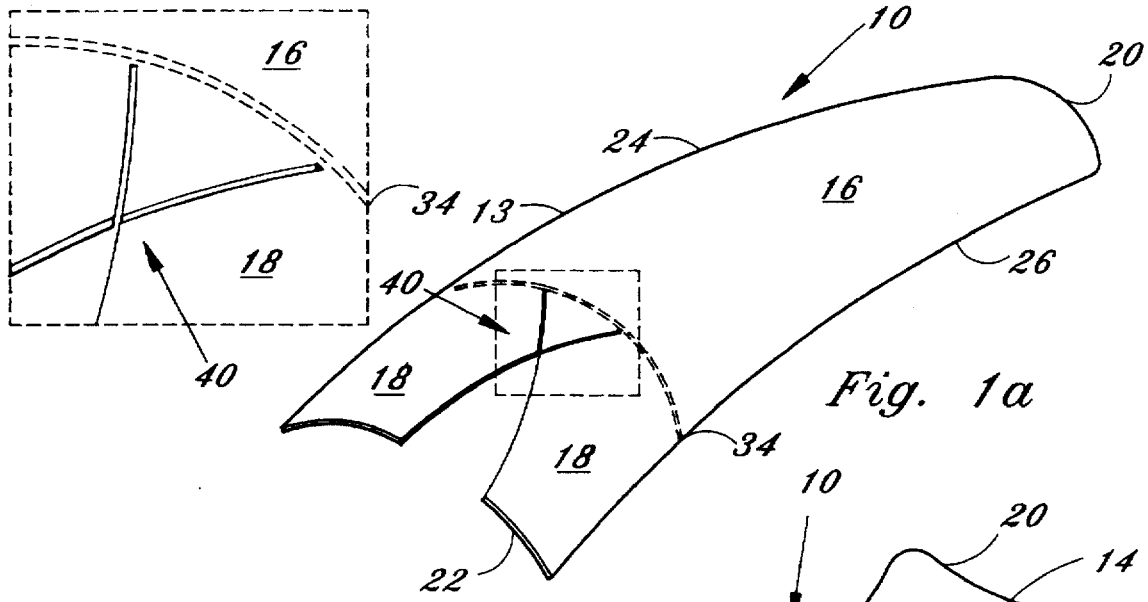
FIG. 1*a* is a perspective view illustrating the top surface of a first embodiment artificial nail tip in accordance with the present invention.
Figure 1B:
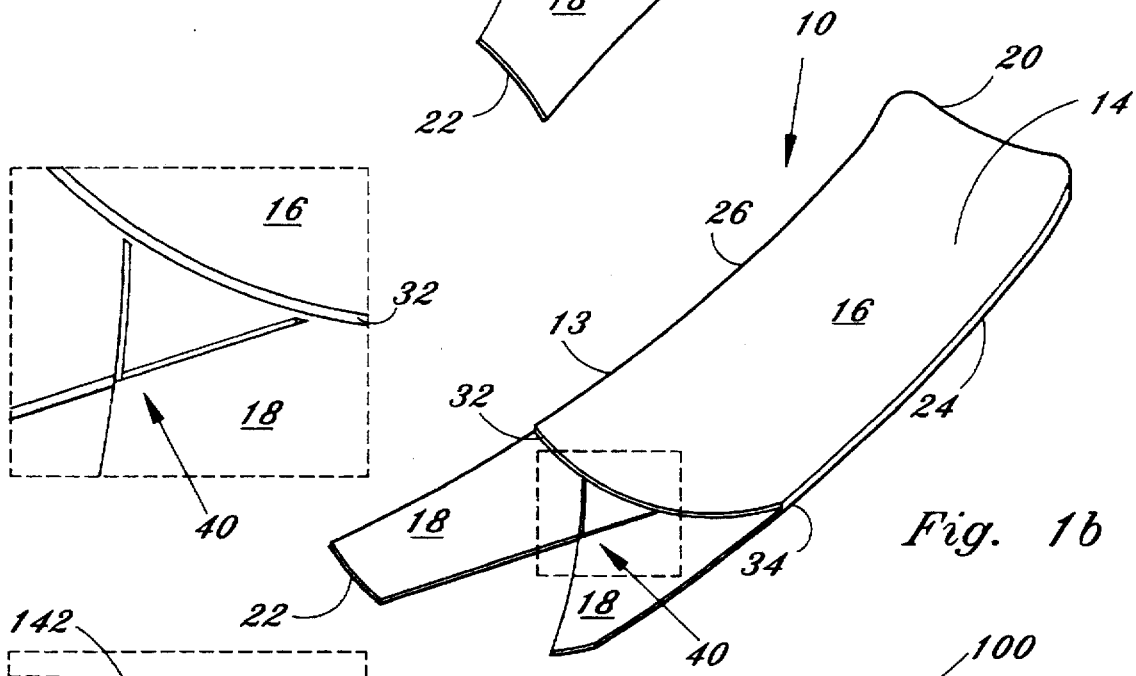
FIG. 1*b* is a perspective view illustrating the bottom surface of the artificial nail tip shown in FIG. 1*a;*

As seen in FIGS. 1*a* and 1*b*, a first embodiment of an artificial nail tip in accordance with the present invention is shown and generally designated as reference numeral 10.

Artificial nail tip 10 includes a top surface and a bottom surface 14, as well as a front portion 16 and a back portion 18. Front portion 16 and back portion 18 are preferably constructed integral to form a one piece body member 13 for nail tip 10.

Nail tip 10 is preferably constructed from a plastic like material such as ABS Plastic, tenite acetate, or nylon, and is generally rectangular in shape. Nail tip 10 is not limited to any particular dimensions, and preferably, a plurality of nail tips 10, of various dimensions, can be sold as a package, in order to provide a selection to the user.

Nail tip 10 has a defined length extending from a first edge 20 and to a second edge 22. Furthermore, front portion 16 and back portion 18 each have their own respective defined lengths which together equal the entire length of nail tip 10 which extends from first edge 20 to second edge 22. The corners of second edge 22 can be rounded to provide more comfort to the user, as well as providing a better fit of nail tip 10 to a natural nail bed (not shown).

Preferably, the length of front portion 16 is greater than the length of back portion 18. First edge 20 also defines a first outer end of front portion 16, while second edge 22 also defines a first outer end of back portion 18. Nail tip 10 also has a defined width extending from a first side edge 24 to a second side edge 26 with the shape of nail tip 10 from first side edge 24 to second side edge 26 being slightly curved.

Back portion 18 is relatively thinner as compared to front portion 16 to allow nail tip 10 to blend in better with the user's natural nail (not shown) after nail tip has been glued on to the natural nail, discussed in detail below. Thinner back portion 18 defines an attachment area where artificial nail tip 10 is attached to a user's natural nail. Preferably, a small wall 32 is created at point 34 where thinner back portion 18 meets front portion 16, which can serve as a guide to properly place nail tip 10 on the wearer's natural nail. Preferably, nail tip 10 is attached to the natural nail such that the outer end of the wearer's natural nail is adjacent or approximate to wall 32 at point 34.

A substantially "X" shaped cutout 40 is defined in back portion 18 to provide strength to artificial nail tip 10, as well as reducing the chance of cracking or weakening nail tip 10 during the procedure of conforming nail tip 10 to the wearer's natural nail.

The "X" shaped cutout 40, preferably, extends across at least a substantial portion of the length of the back portion 18, and can extend across the entire length of back portion 18 if desired. "X" shaped cutout 40 is also preferably disposed at the middle of the width of back portion. Preferably, "X" shaped cutout 40 will be provided in back portion 18 during the molding of nail tip 10, by providing for such design in the mold itself.

To attach nail tip 10 to a natural nail, a conventional glue, such as a cyanoacrylate adhesive, is provided to attach nail tip 10 to the natural nail. Nail tip 10 is then filed by conventional means to the desired shape and length, and preferably provided with a coating for increased strength. When initially applying nail tip 10 to the natural nail, nail tip 10 is pressed down and held tightly, by conventional means, against the natural nail, to provide for maximum adhesion and to prevent any space between nail tip 10 and the natural nail.

"X" shaped cutout 40 helps to reduce cracking or weakening of nail tip 10 by transferring the stress on nail tip 10 often produced during the stage of conforming nail tip 10 to the natural nail. This advantage of the present invention is provided regardless of the contour of the natural nail. Furthermore, as the present invention allows nail tip 10 to be applied to the natural nail without creating any space between nail tip 10 and the natural nail, air pockets are eliminated which could otherwise promote the growth of fungus or mildew on the natural nail. Additionally, the elimination of any space between nail tip 10 and the natural nail, also provides for better adhesion of nail tip 10 to natural nail.

As most of nail 10's needed strength comes from the artificial nail tip coating, after it has been applied to the natural nail, it is important that the coating is able to adhere to the natural nail. "X" shaped cutout 40 in back portion 18 exposes more of the natural nail, thus providing a larger area of the natural nail, as compared to conventional artificial nail tips, for the coating to adhere to. The strength of artificial nail tip 10 is directly proportional to the amount of exposed natural nail. Thus, as more of the natural is exposed for adhering, the more strength nail tip 10 will be provided with.

"X" shaped cutout 40 also allows the side of nail tip 40 to extend up either side of the natural nail, providing additional gluing surface, as compared to conventional artificial nail tips having their back cut out, and also provides for additional support. "X" shaped cutout 40 also serves the purpose of allowing the applier of nail tip 10 to blend nail tip 10 easily into the natural nail, giving it a natural look to the eye when the application of nail tip 10 to the natural nail is completed.

Figure 2A:
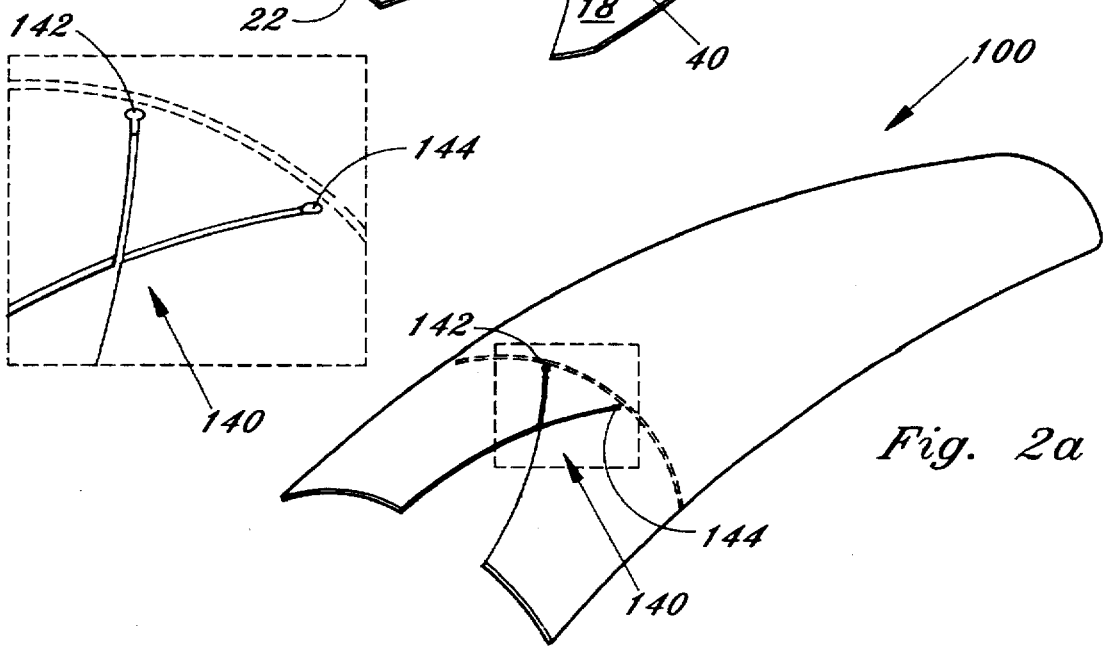
FIG. 2*a* is a perspective view illustrating the top surface of a second embodiment artificial nail tip in accordance with the present invention.
Figure 2B:
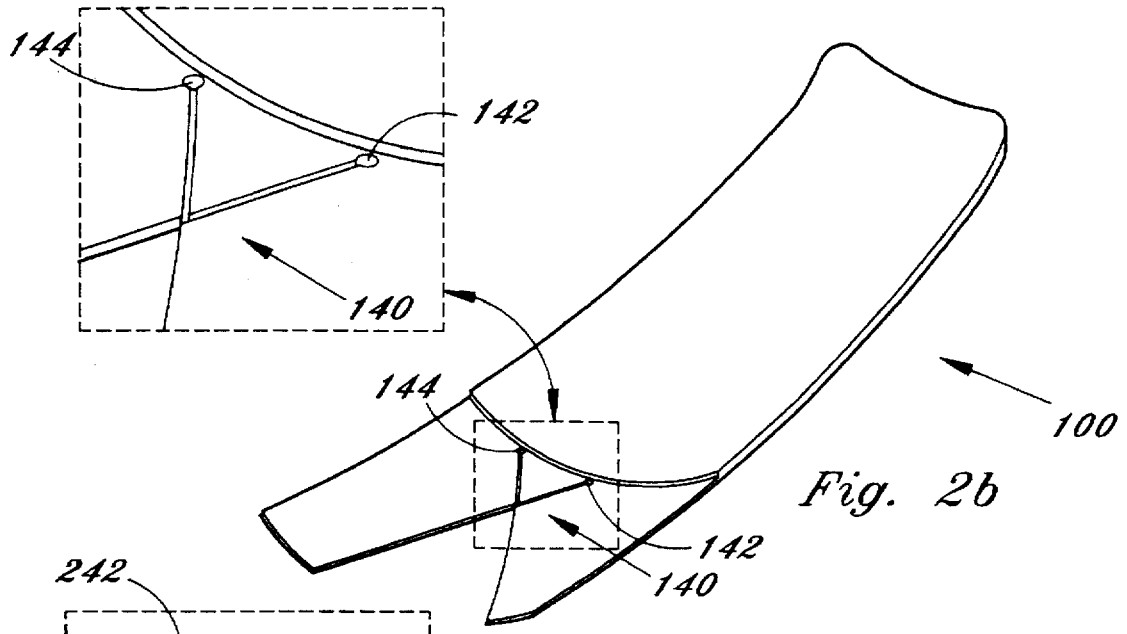
FIG. 2*b* is a perspective view illustrating the bottom surface of the artificial nail tip shown in FIG. 2*a;*

FIGS. 2*a* and 2*b* illustrate a second embodiment artificial nail tip 100 which is similar to nail tip 10 and is provided with a cutout 140 which is also substantially "X" shaped to provide all of the advantages for nail tip 100 as those described above for nail tip 10 having cutout 40. As seen in FIGS. 2*a* and 2*b*, small rounded areas are provided at ends 142 and 144 of cutout 140, which helps to further alleviate stress produced while conforming nail tip 100 to the natural nail as discussed above. All other design features of nail tip 100 are similar to those discussed above for nail tip 10.

Figure 3A:
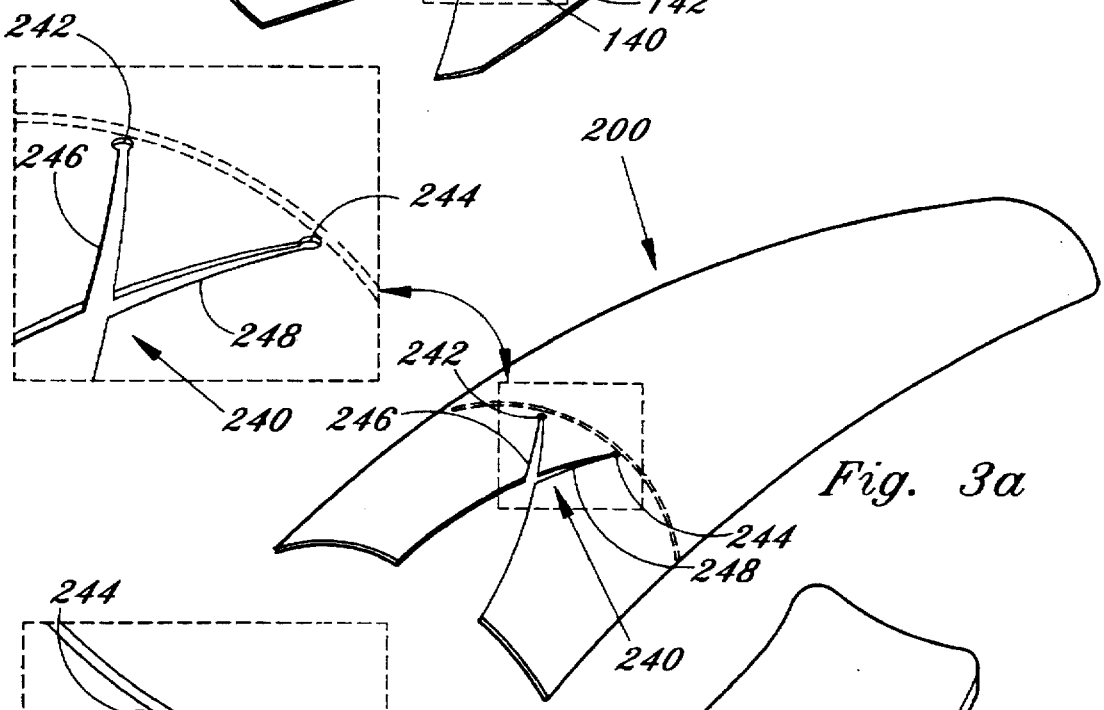
FIG. 3*a* is a perspective view illustrating the top surface of a third embodiment artificial nail tip in accordance with the present invention.
Figure 3B:
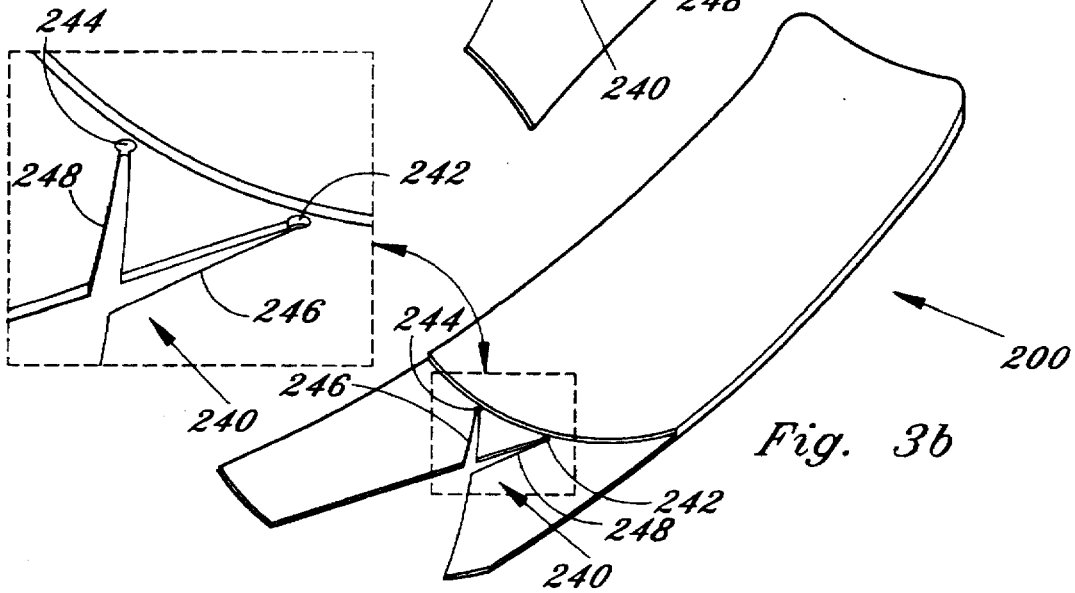
FIG. 3*b* is a perspective view illustrating the bottom surface of the artificial nail tip shown in FIG. 3*a;*

FIGS. 3*a* and 3*b* illustrate a third embodiment artificial nail tip 200 which is also similar to nail tip 10 and is provided with a cutout 240 which is also substantially "X" shaped to also provide all of the advantages for nail tip 200 as those described above for nail tip 10 having cutout 40. As seen in FIGS. 3*a* and 3*b*, small rounded areas are provided at ends 242 and 244 of cutout 240, which helps to further alleviate stress produced while conforming nail tip 200 to the natural nail as discussed above. Furthermore legs 246 and 248 of "X" shaped cutout 240 are wider as compared to cutouts 40 and 140, of nail tips 10 and 100, respectively. This feature also helps to reduce stress produced during the conforming of nail tip 200 to the natural nail. All other design features of nail tip 200 are similar to those discussed above for nail tip 10.

In all embodiments, the axial curvature of the attachment area is defined by a single radii which is taken from the top of the attachment area. Also for all the embodiments, the "X" shaped cutout defines a pointed or sharp spot where the leg member meets the remaining portion of the cutout. Furthermore, the spot where the outer end of the cutout meets the outer edge of the back portion is also pointed and sharp.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An artificial nail tip, comprising:

a body member having a front portion and a back portion, said back portion defining a substantially "X" shaped cut disposed therein, a first end of said substantially "X" shaped cut approximate to an outer end of said back portion, said back portion also defining an attachment area for attaching said body member to a natural nail; said back portion being relatively thinner than said front portion.

2. The artificial nail tip of claim 1 wherein said back portion has a certain length, said cutout extending for a substantial portion of the length of said back portion.

3. The artificial nail tip of claim 1 wherein said front portion and said back portion are constructed integral to form a one piece body member.

4. The artificial nail tip of claim 1 wherein said back portion has an exposed outer end and an inner end.

5. The artificial nail tip of claim 1 wherein said "X" shaped cutout includes a pair of leg members.

6. The artificial nail tip of claim 5 wherein said leg members is relatively wide in shape to help alleviate stress normally produced when conforming said body member to the natural nail.

7. An artificial nail tip, comprising:

a body member having a front portion and a back portion, said back portion defining a substantially "X" shaped cutout disposed therein, said back portion also defining an attachment area for attaching said body member to a natural nail, said back portion having an exposed outer end and an inner end, said "X" shaped cutout begins at said exposed outer end and extends along said back portion to said inner end.

8. The artificial nail tip of claim 7 wherein said front portion and said back portion are constructed integral to form a one piece body member.

9. The artificial nail tip of claim 7 wherein said "X" shaped cutout includes a pair of leg members.

10. The artificial nail tip of claim 9 wherein said leg members is relatively wide in shape to help alleviate stress normally produced when conforming said body member to the natural nail.

11. The artificial nail tip of claim 9 wherein said leg members have rounded outer ends to help alleviate stress normally produced when conforming said body member to the natural nail.

12. The artificial nail tip of claim 7 wherein said back portion is relatively thinner than said front portion.

13. An artificial nail tip, comprising:

a body member having a front portion and a back portion, said back portion defining a substantially "X" shaped cutout disposed therein, said back portion also defining an attachment area for attaching said body member to a natural nail, said back portion having an exposed outer end and an inner end, said "X" shaped cutout extending a substantial portion of a distance defined from said inner end to said exposed outer end.

14. The artificial nail tip of claim 13 wherein said "X" shaped cutout includes a pair of leg members.

15. The artificial nail tip of claim 14 wherein said leg members is relatively wide in shape to help alleviate stress normally produced when conforming said body member to the natural nail.

16. The artificial nail tip of claim 14 wherein said leg members have rounded outer ends to help alleviate stress normally produced when conforming said body member to the natural nail.

17. The artificial nail tip of claim 13 wherein said back portion is relatively thinner than said front portion.

18. An artificial nail tip, comprising:

a body member having a front portion and a back portion, said back portion defining a substantially "X" shaped cutout disposed therein, said back portion also defining an attachment area for attaching said body member to a natural nail; said back portion being relatively thinner than said front portion, said "X" shaped cutout includes a pair of leg members; wherein said leg members have rounded outer ends to help alleviate stress normally produced when conforming said body member to the natural nail.

19. An artificial nail tip, comprising:

body member having a front portion and a back portion, said back portion being relatively thinner than said front portion, said back portion defining a substantially "X" shaped cutout disposed therein, said back portion also defining an attachment area for attaching said body member to a natural nail, said front portion and said back portion constructed integral to form a one-piece body member, said "X" shaped cutout including a pair of leg members which are relatively wide in shape to help alleviate stress normally produced when conforming said body member to the natural nail, a first end of said substantially "X" shaped cutout approximate to an outer end of said back portion.

20. An artificial nail tip, comprising:

a body member having a front portion and a back portion, said back portion being relatively thinner than said front portion, said back portion defining a substantially "X" shaped cutout disposed therein, said back portion also defining an attachment area for attaching said body member to a natural nail, said front portion and said back portion constructed integral to form a one-piece body member, said "X" shaped cutout including a pair of leg members having rounded outer ends to help alleviate stress normally produced when conforming said body member to the natural nail.

* * * * *